US006351900B1

(12) United States Patent
DeWind

(10) Patent No.: US 6,351,900 B1
(45) Date of Patent: Mar. 5, 2002

(54) SHAFT DRIVEN TRENCHER

(76) Inventor: Gregory A. DeWind, 9150--96th St., Zeeland, MI (US) 49464

( * ) Notice: Subject to any disclaimer, the term of this patent is extended or adjusted under 35 U.S.C. 154(b) by 0 days.

(21) Appl. No.: 09/615,456

(22) Filed: Jul. 13, 2000

(51) Int. Cl.[7] ..... E02F 3/65
(52) U.S. Cl. ..... 37/362; 37/380
(58) Field of Search ..... 37/352, 353, 355, 37/362, 380

(56) References Cited

U.S. PATENT DOCUMENTS 2,772,491 A * 12/1956 Stansbury
3,754,341 A * 8/1973 Caldwell et al.
3,929,198 A * 12/1975 Dalton
4,043,135 A * 8/1977 Hoes et al.
4,195,427 A 4/1980 Lanham
4,259,872 A * 4/1981 Chandler
4,682,427 A 7/1987 Dondi
4,833,797 A * 5/1989 Slunecka et al.
5,245,769 A * 9/1993 Wammock
5,664,347 A * 9/1997 Chapman, Sr. et al.
6,148,549 A * 11/2000 Bykov et al.

* cited by examiner

*Primary Examiner*—H. Shackelford
(74) *Attorney, Agent, or Firm*—Price, Heneveld, Cooper, DeWitt & Litton

(57) ABSTRACT

A shaft driven trencher including a mobile powered base, a boom assembly, a chain digging assembly, a drive assembly and a linkage. The boom assembly includes a first boom member pivotally mounted to the base at a first pivot and a second boom member pivotally mounted to the first boom member. The chain digging assembly has a plurality of buckets. The drive assembly operably interconnects the mobile base and the chain digging assembly, with the drive assembly including a drive shaft connected to the mobile base for powered rotation of the drive shaft. The drive assembly further includes a right angle gear unit with input and output shafts, with the right angle gear unit being pivotally mounted to the boom assembly for rotation about the output shaft. The linkage interconnects the right angle gear unit with the base and pivots the right angle gear unit during rotation of the first boom member. The linkage also maintains the input shaft of the right angle gear unit facing the first pivot.

22 Claims, 5 Drawing Sheets

SHAFT DRIVEN TRENCHER

BACKGROUND OF THE INVENTION

Various types of trenchers have been developed for digging trenches for pipe lines, communications lines, and the like. Existing trenchers commonly include a looped chain type digging mechanism having a plurality of buckets that move the soil upwardly out of the trench during the digging process. Such trenchers may include a chain drive arrangement that transfers power from the trencher's engine to the digging chain and buckets. However, such chain drives are prone to breakage, and have limited capacity for transferring power. Further, known trenchers of this type are relatively small, and are thus limited to relatively shallow trenches.

Another prior art trencher arrangement includes a mobile, powered base including a boom assembly. The boom assembly includes a first boom member pivotally mounted to the powered base, and a second boom member pivotally mounted to the opposite end of the first boom. A digging chain is looped along the second boom, and a drive shaft transfers power to the digging chain via a ninety degree drive positioned adjacent the pivotal interconnection of the first and second booms. In use, the first boom is rotated downwardly to a position approximately parallel to the ground surface, and the second boom and chain are oriented approximately vertical. To transport the trencher, the first boom is rotated upwardly to about a forty-five degree angle, and the second boom is rotated upwardly about the pivotal connection to the first boom to raise the digging chain above the ground surface, thereby permitting movement of the mobile base. However, the drive shaft interconnecting the powered base and the ninety degree drive unit has a single universal joint at each end. Because the universal joints are only operable within a relatively small angular range of motion, the upward rotation of the first boom relative to the powered base is limited. Further, in this type of trencher the ninety degree drive unit rotates with the second boom, such that the universal joint connecting the ninety degree drive unit to the drive shaft is placed at an angle when the second boom is rotated upwardly for transport of the trencher. The range of allowable rotation of the first boom relative to the powered base is limited, as is the rotation of the second boom relative to the first boom such that the overall length of the second boom is necessarily quite short to permit movement of the digging chain above the level of the soil surface for transport. These limited rotational ranges, and the relatively short second boom and digging chain necessarily limits this type of trencher to a relatively shallow trenching capability.

Another example of a shaft driven trencher is disclosed in Dondi U.S. Pat. No. 4,682,427. The Dondi trencher includes a laterally-extending boom mounted on a tractor. A wheel and disc are rotationally mounted adjacent the end of the boom for digging a trench. However, the Dondi trencher also has limited capability.

Accordingly, there existed a need for a durable trencher capable of digging deep trenches at a high digging rate.

SUMMARY OF THE INVENTION

One aspect of the present invention is to provide a shaft driven trencher including a mobile powered base, a boom assembly, a chain digging assembly, a drive assembly and a linkage. The boom assembly includes a first boom member pivotally mounted to the base at a first pivot and a second boom member pivotally mounted to the first boom member. The chain digging assembly has a plurality of buckets. The drive assembly operably interconnects the mobile base and the chain digging assembly, with the drive assembly including a drive shaft connected to the mobile base for powered rotation of the drive shaft. The drive assembly further includes a right angle gear unit with input and output shafts, with the right angle gear unit being pivotally mounted to the boom assembly for rotation about the output shaft. The linkage interconnects the right angle gear unit with the base and pivots the right angle gear unit during rotation of the first boom member. The linkage also maintains the input shaft of the right angle gear unit facing the first pivot.

Another aspect of the present invention is to provide a shaft driven trencher including a mobile powered base, a boom assembly, a chain digging assembly, a drive shaft, a linkage and a pivot assembly. The boom assembly includes a first boom member pivotally mounted to the base at a first pivot and a second boom member pivotally mounted to the first boom member. The chain digging assembly has a plurality of buckets. The drive shaft includes a first drive segment and a second drive segment, with the first drive segment being connected to the second drive segment by a universal joint. The linkage rotates and supports the second drive segment. The pivot assembly is operably connected to the linkage and the first drive segment, with the pivot assembly including a pillow block operably connected to the linkage and the first drive segment. The pillow block rotates and supports the first drive segment. Furthermore, the universal joint is located between the pivot assembly and the member, thereby permitting greater elevation of the boom and reducing the angle of the universal joint.

Yet another aspect of the present invention is to provide a shaft driven trencher including a mobile powered base, a boom assembly, a chain digging assembly, a drive shaft, a right angle gear unit and a pivot and linkage assembly. The drive shaft includes a first drive segment connected to a second drive segment by a universal joint. The right angle gear unit includes input and output shafts, with the right angle gear unit pivotally mounted to the boom assembly of the shaft driven trencher for rotation about the output shaft. The right angle gear unit is also connected to the second drive segment whereby the second drive segment rotates the input and output shafts. The pivot and linkage assembly supports and rotates the drive shaft and the right angle gear unit, with the pivot and linkage assembly including a linkage operably coupled to the first drive segment, the second drive segment and the right angle gear unit. The pivot and linkage assembly includes a pillow block, an arm and a pair of arcuate tracks, with the pillow block being interconnected to the base and supporting the first drive segment. The pillow block also is configured to slide with the arcuate tracks. The arm is interconnected to the pillow block and the linkage. The linkage interconnects the right angle gear unit with the base, pivots the right angle gear unit during rotation of the first boom member and maintains the input shaft of the right angle gear unit facing the first pivot.

The shaft driven trencher is efficient in use, economical to manufacture, capable of a long life, and particularly suited for digging very deep trenches. These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
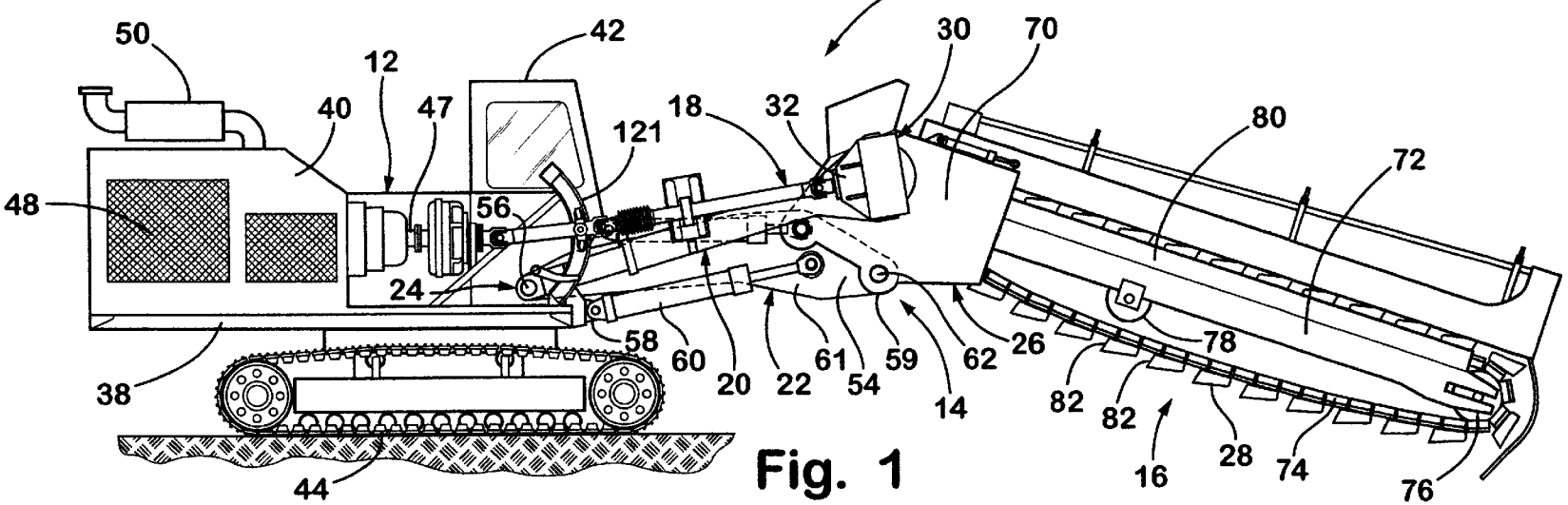
FIG. 1 is a side elevational view of a trencher embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
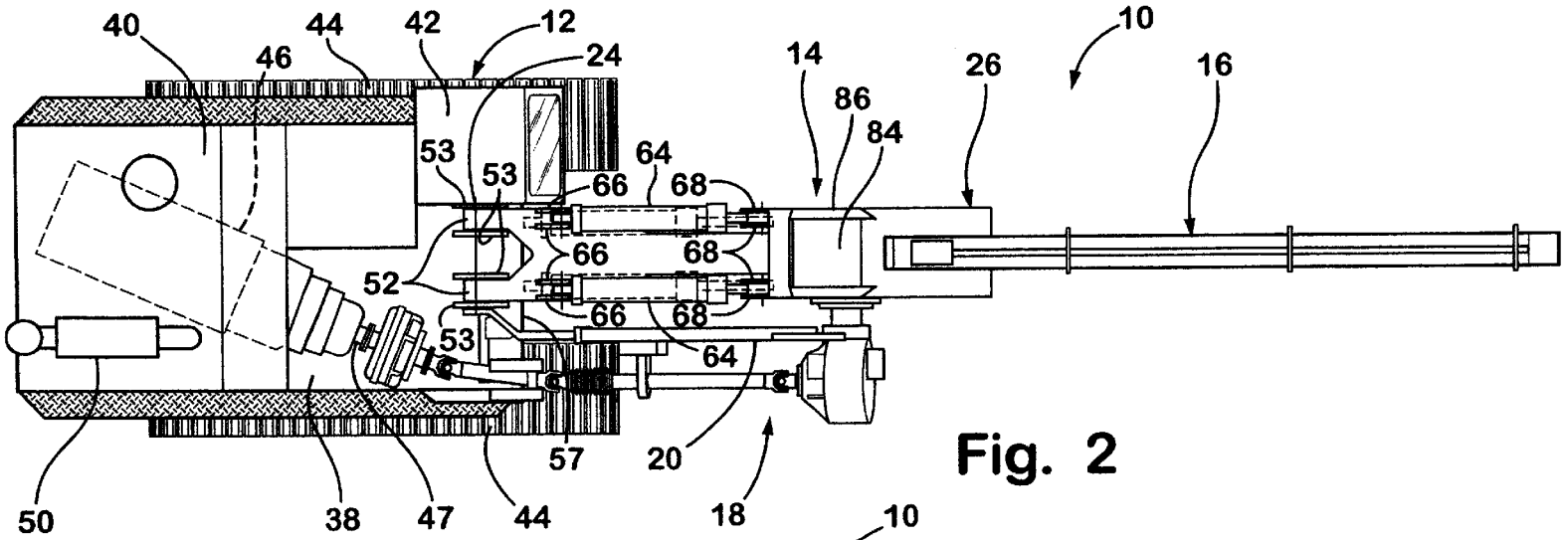
FIG. 2 is a top plan view of the trencher of FIG. 1.

The reference number 10 (FIG. 1) generally designates a shaft driven trencher embodying the present invention. In the illustrated example the shaft driven trencher 10 includes a mobile powered base 12 having a power source such as motor 46 (see also FIG. 2), a boom assembly 14, a chain digging assembly 16, a drive assembly 18 and a linkage 20. The boom assembly 14 includes a first boom member 22 pivotally mounted to the base 12 at a first pivot 24 and a second boom member 26 pivotally mounted to the first boom member 22. The chain digging assembly 16 has a plurality of buckets 28 for raising material from the ground during operation. The chain digging assembly 16 is movably mounted on the second boom member 26 and forms a loop configured to dig during operation. The drive assembly 18 operably interconnects the mobile base 12 and the chain digging assembly 16, with the drive assembly 18 including a drive shaft 30 connected to the mobile base 12 for powered rotation of the drive shaft 30. The drive assembly 18 further includes a right angle gear unit 32 with input 34 and output 36 shafts forming a right angle therebetween and transferring torque from the input shaft 34 to the output shaft 36. The right angle gear unit 32 is pivotally mounted to the boom assembly 14 for rotation about the output shaft 36. The linkage 20 interconnects the right angle gear unit 32 with the base 12 and pivots the right angle gear unit 32 during rotation of the first boom member 22. The linkage 20 also maintains the input shaft 34 of the right angle gear unit 32 extending generally towards the first pivot 24.

The illustrated mobile powered base 12 includes a floor plate 38 with a motor housing 40 and a passenger compartment 42 attached to the top of the floor plate 38. A track assembly 43 includes a pair of tracks 44 located below the floor plate 38 to move and position the base 12. It is contemplated that the base 12 could be stationary or moved by other means, including wheels. The motor housing 40 retains an internal combustion engine such as rotary motor 46 having an output shaft 47 for connection to and powered rotation of the drive shaft 18. In the illustrated example, the motor compartment 40 also includes a vent 48 for cooling the rotary motor 46 and an exhaust pipe 50 for expelling exhaust gases from the rotary motor 46. An operator of the trencher 10 sits in the passenger compartment 42 and controls the movement of the base 12 and the boom assembly 14.

Figure 8:
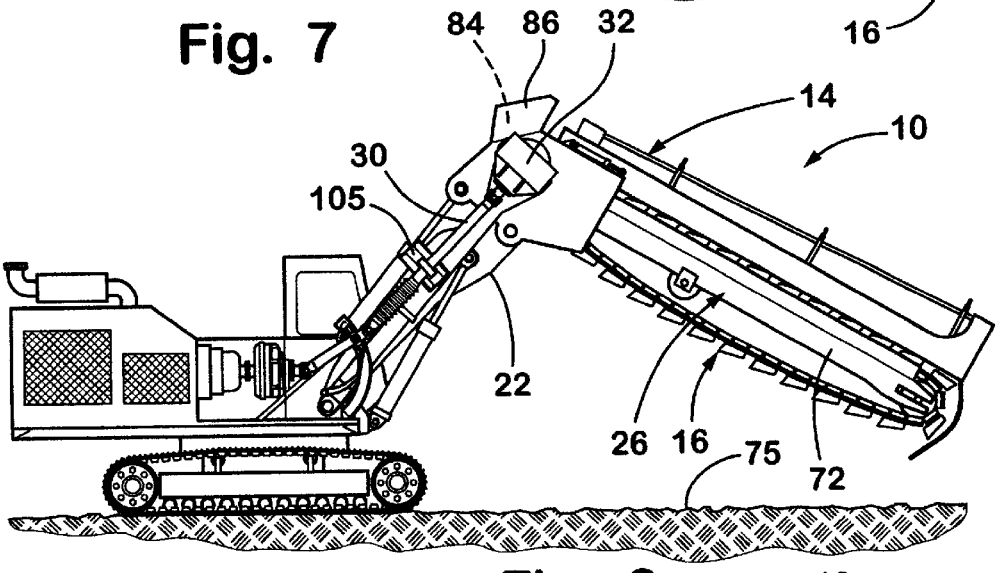
FIG. 8 is a side elevational view of the trencher of FIG. 1 wherein the digging chain is above ground level for transport of the trencher.

In the illustrated example, the first boom member 22 of the boom assembly 14 is attached to the base 12 at the first pivot point 24. The first boom member 22 has an elongated main body portion 54 and a pair of parallel legs 52 extending towards the base 12. Two first pairs of inverted U-shaped sleeves 53 are attached to the top of the front of the base 12 and centrally located adjacent the passenger compartment 42 sleeves 53 pivotally retain the ends of each of the parallel legs 52 of the first boom member 22 by means of a pivot pin 56 extending through each pair of sleeves 53 and one of the pair of parallel legs 52. Accordingly, the pivot pins 56 are located at the first pivot point 24, and the first boom member 22 is rotatable about the sleeves 52 and the base 12 at the first pivot point 24. The base 12 also has a second pair of U-shaped sleeves 58 attached to a front side edge 57 of the floor plate 38, with the second pair of U-shaped sleeves 58 located outside of the first pair of U-shaped sleeves 53. A first pair of telescoping hydraulic cylinders 60 are pivotally attached to the second pair of U-shaped sleeves 58 and to side faces 61 of the elongated main body portion 54 at a distal end 59 of the first boom member 22. The operator in the passenger compartment 42 can control the rotational movement of the first boom member 22 by extending and retracting the first pair of hydraulic cylinders 60 in order to raise or lower the main body portion 54, thereby rotating the first boom member 22 about the first pivot point 24. The first boom member 22 therefore rotates between a first position substantially parallel with the bottom plate 38 (FIG. 9) and a second position at an angle approximately 45 degrees relative to the bottom plate 38 (FIG. 8).

The illustrated second boom member 26 of the boom assembly 14 is pivotally attached to the distal end 59 of the first boom member 22 by pivot pins 62, thereby allowing the second boom member 26 to rotate relative to the first boom member 22. As seen from the top of the shaft driven trencher 10 in FIG. 2, the first boom member 22 and the second boom member 26 extend linearly from the base 12. The second boom member 26 includes a housing 70 and a longitudinal arm 72 extending from the housing 70 in a direction away from the base 12. As described in more detail below, the arm 72 supports the chain digging assembly 16. The second boom member 26 is connected to the first boom member 22 by pivot pins 56 on each side face 71 of the housing 70 of the second boom member 21. Pins 56 extend into the main body portion 54 of the first boom member 22. A second pair of telescoping hydraulic cylinders 64 are each attached to a third pair of U-shaped sleeves 66 on a top face 63 of the elongated main body portion 54 of the first boom member 22 and to a fourth pair of sleeves 68 on the housing 70 of the second boom member 26 adjacent the top of the housing 70. The operator in the passenger compartment 42 can control the movement of the second boom member 26 about pin 62, and therefore the arm 72, by extending and retracting the second pair of hydraulic cylinders 64 thereby rotating the second boom member 22 relative to the first boom member 22. The second boom member 26 therefore rotates between a first position substantially parallel with the first boom member 22 (FIG. 7) and a second position substantially perpendicular to the first boom member 22 (FIG. 8).

In the illustrated example, the chain digging assembly 16 extends around the longitudinal arm 72 of the second boom member 26. The chain digging assembly 16 includes a chain 74 and the buckets 28. The chain 74 surrounds the top and the bottom of the arm 72, forming an elongated oval loop. The longitudinal arm 72 includes a wheel 76 on each longitudinal end of the longitudinal arm 72 that guides and supports the chain 74. As described in more detail below, the drive assembly 18 rotates the wheel 76 in housing 70 in the clockwise direction, thereby forcing the chain 74 to rotate in the clockwise direction longitudinally about the arm 72. The arm 72 of the second boom member 26 also has an auxiliary guide wheel 78 located on the bottom of the arm 72 to help direct the chain about the arm 72 during digging. A longitudinal guide track 80 extends parallel with and adjacent the top of the arm 72. The longitudinal guide track 80 has an inverted U-shape that guides the chain 74. The buckets 28 of the chain digging assembly 16 are located about the circumference of the chain 74. The buckets 28 have a receptacle with an opening 82 facing the base 12 along the bottom of the chain 74 and facing away from the base 12 along the top of the chain 74. Therefore, as the chain 74 is rotated in the clockwise direction, the opening 82 of the receptacles on the bottom of the chain 74 will move towards the base 12 and the opening 82 of the receptacles on the top of the chain 74 will move away from the base 12.

Figure 3:
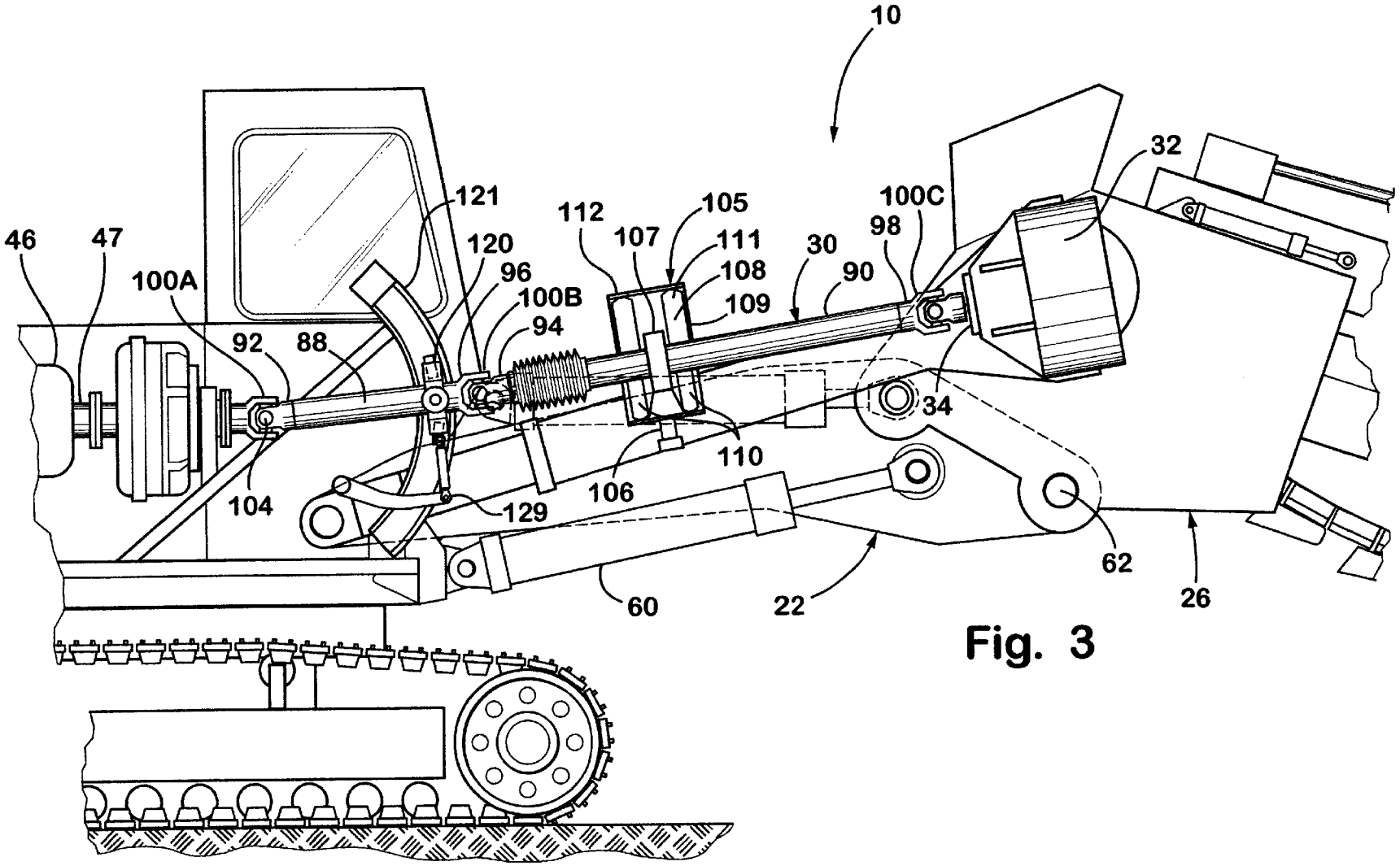
FIG. 3 is a partially fragmentary, side elevational view of the trencher of FIG. 1 illustrating the drive shaft, and linkage assembly.
Figure 4:
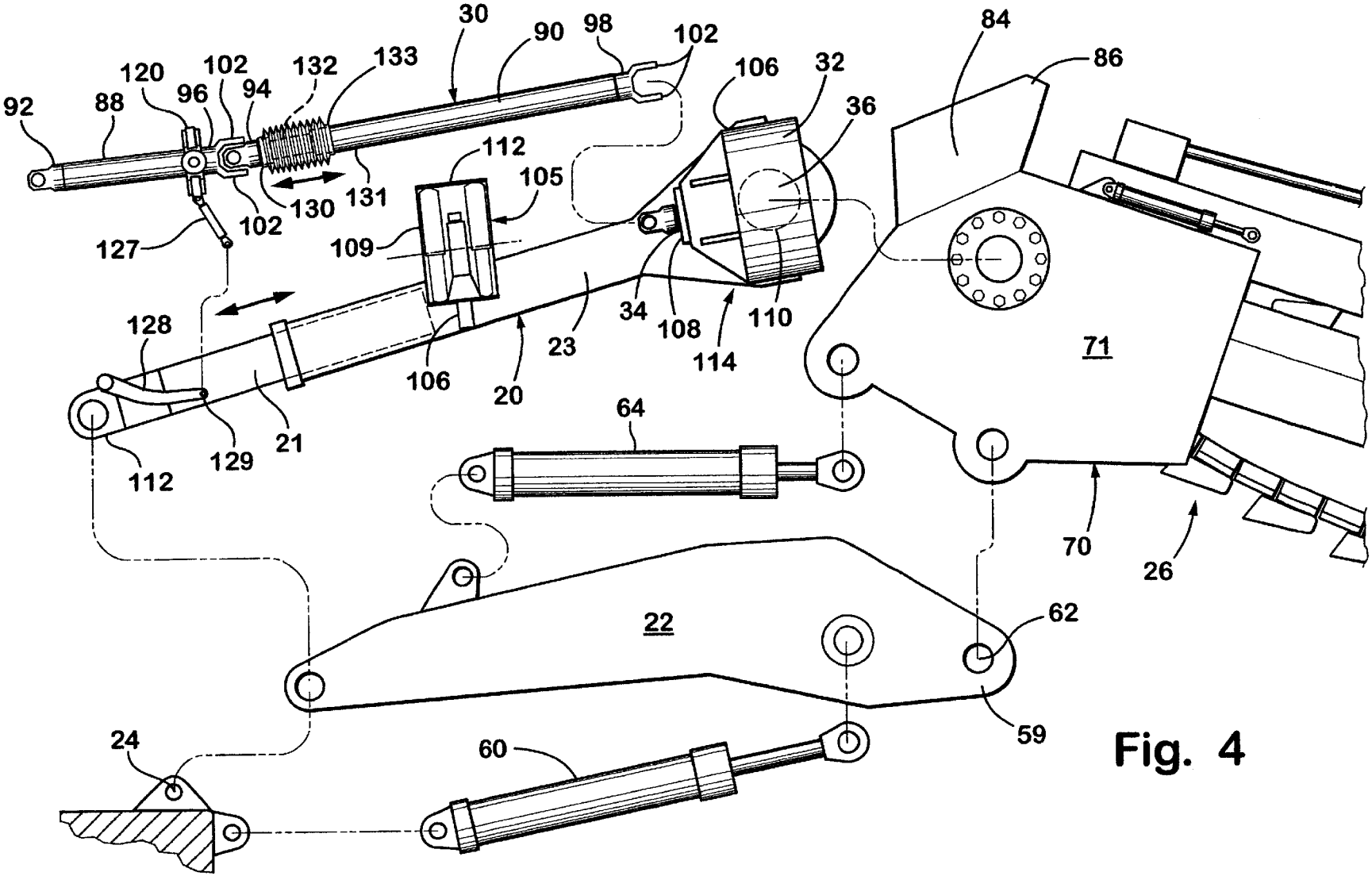
FIG. 4 is a partially fragmentary, exploded view of the drive shaft and linkage of FIG. 3.

With further reference to FIGS. 3 and 4, the drive assembly 18 controls the rotary motion of the chain digging assembly 16 of the shaft driven trencher 10. The drive assembly 18 also operably interconnects the mobile base 12 and the chain digging assembly 16. The illustrated drive assembly 18 includes the drive shaft 30 and the right angle gear unit 32. The drive shaft 30 has a first drive segment 88 and a second drive segment 90. The first drive segment 88 is a cylindrical rod connected at a first end 92 to the output shaft 47 of the motor 46 on the mobile base 12. The second drive segment 90 is connected at a first end 94 to a second end 96 of the first drive segment 88 and at a second end 98 to the right angle gear unit 32. Universal joints 100 connect the output shaft 47 of the rotary motor 46 to the first drive segment 88, the first drive segment 88 to the second drive segment 90 and the second drive segment 90 to the right angle gear unit 32. Each universal joint 100 includes a pair of U-shaped forks 102. Each U-shaped fork 102 has a pivot pin 104 extending between two prongs 106 of the U-shaped fork 102. The U-shaped forks 102 are perpendicular to each other such that the pivot pins 104 between the prongs 106 of the U-shaped forks 102 are also perpendicular. The pivot pins 104 are connected at a center point, thereby allowing one of the pivot pins 104 to rotate freely about an X-axis and the other of the pivot pins 104 to rotate freely about an Y-axis. Consequently, the universal joint 100 allows the first drive segment 88 to rotate about the end of the output shaft 47 of the rotary motor 46 while still transferring rotary motion along a Z-axis to the first drive segment 88, wherein the Z-axis is defined along the axis of rotation of the output shaft 47 of the rotary motor 46. Likewise, the universal joint 100 allows the second drive segment 90 to rotate about the second end 96 of the first drive segment 88. In the illustrated example, the output shaft 47 of the motor 46 is positioned at an oblique angle relative to the boom assembly 14. Furthermore, the first drive segment 88 is positioned at a small angle relative to the boom assembly 14 and the second drive segment 90 is positioned parallel with the boom assembly 16. Therefore, the universal joints 100 between the output shaft of the rotary motor 46 and the first drive segment 88, and between the first drive segment 88 and the second drive segment 90, allow the motor 46 to transfer rotary motion from the motor 46 to the right angle gear unit 32.

The drive assembly 18 further includes right angle gear unit 32 with input shaft 34 and output shaft 36, the right angle gear unit 32 being pivotally mounted to the boom assembly 14 for rotation about the output shaft 36. The right angle gear unit 32 is attached to the side face 71 of the housing 70 of the second boom assembly 26 whereby the right angle gear unit 32 can rotate relative to the housing 70. The right angle gear unit 32 is also connected to the drive shaft 30 for rotation of the input shaft 34 with the drive shaft 30. The input shaft 34 and the output shaft 36 of the right angle gear unit 32 are housed within and extend out of a right angle housing 106. The input shaft 34 and the output shaft 36 are operably connected within the right angle housing 106 whereby rotation of the input shaft 34 is translated though 90 degrees to rotation of the output shaft 36. The right angle housing 106 includes a circular input opening 108 that faces the base 12 and a circular output opening 110 that faces the housing 70 of the second boom assembly 26. The input shaft 34 extends through the input opening 108 and, as described above, one of the universal joints 100 connects the second drive segment 90 to the input shaft 34 of the right angle gear unit 32. Furthermore, the output shaft 34 extends through the output opening 110 and into the housing 70 of the second boom assembly 26, where the output shaft 34 is connected to the wheel 76 in the housing 70. The output shaft 34 therefore rotates the wheel 76 located within housing 70 and chain 74 of the chain digging assembly 16. Therefore, the motor 46 rotates the chain digging assembly 16 by transmitting torque through the first drive segment 88, the second drive segment 90 and the input shaft 34 and the output shaft 36 of the right angle gear unit 32.

In the illustrated example, the rotary connection of the right angle gear unit 32 to the boom assembly 14 allows the first boom member 22 to rotate to an angle approximately 45 degrees relative to the base 12. As described above, the right angle gear unit 32 is connected to the housing 70 of the second boom member 26. Furthermore, the housing 70 of the second boom member 26 is connected to the distal end 59 of the first boom member 22. Therefore, the right angle gear unit 32 will rise when the distal end 59 of the first boom member 22 is rotated upward. Moreover, the input shaft 34 of the right angle gear unit 32 is connected to the rotary motor 46 through the two-piece drive shaft 30. Consequently, the pivotal connection of the right angle gear unit 32 to the housing 70 allows the circular input opening 108 and the input shaft 34 of the right angle gear unit 32 to rotate downward to face the rotary motor 46 as the distal end 59 of the first boom member 22 is rotated upward. Because the input shaft 34 extends towards the rotary motor 46, the first boom member 22 can rotate to an angle approximately 45 degrees relative to the base 12 with the drive shaft 30 still operably connected to the rotary motor 46 and the input shaft 34. Rotation of right angle gear unit 32 ensures that the input shaft 34 remains in approximate axial alignment with drive shaft segment 90, thus ensuring that universal joint 100 interconnecting shafts 34 and 90 remains within its allowable angular range of operation.

In the illustrated example, the linkage 20 of the shaft driven trencher 10 interconnects the right angle gear unit 32 with the base 12 and pivots the right angle gear unit 32 during rotation of the first boom members 22. Linkage 20 includes an elongated inner member 21 pivotally connected at a first end 112 to the pair of inverted U-shaped sleeves 53 opposite the passenger compartment 42. The linkage is thereby attached to the top of the front of the base 12 at the first pivot point 24. Linkage 20 includes an outer member 23 that is fixedly connected at a second end 114 to the right angle gear unit 32 wherein the input shaft 34 is approximately parallel with the linkage 20. Without the connection of the linkage 20 to the right angle gear unit 32, the weight of the input shaft 34 would rotate right angle gear unit 32 about the pivotal connection to the housing 70 of the second boom member 26 until the input, opening 108 faced downward. The linkage 20, however, keeps the input shaft 34 of the right angle gear unit 32 generally extending towards the rotary motor 46 and the mobile base 12. Inner member 21 is slidably and telescopically received in outer member 23 to permit change in the overall length of linkage 20. Output shaft 36 of right angle gear unit 32 is spaced-apart from pivot pin 62, such that rotation of arm 72 relative to boom member 22 results in telescopic extension/retraction of linkage 20. Accordingly, the linkage 20 permits the first boom member 22 to rotate approximately 45 degrees relative to the mobile base 12 with the drive shaft 30 still functioning to rotate the chain digging assembly 16.

A support assembly 105 supports shaft segment 90 on the outer member 23 of linkage 20. Support assembly 105 includes a plate 109 that is slidably mounted to a shaft 106 by a pillow block (not shown). Shaft 106 is mounted to outer linkage member 23, and extends approximately perpendicular to shaft segment 90. A bracket 112 is fixed to the outer linkage member 23, and the upper ends 111 of shock absorbers 108 are secured to the bracket 112. The lower ends 110 of shock absorbers 108 are secured to the plate 109. A large bearing 107 connects the drive shaft segment 90 to the plate 109. Plate 109 travels vertically along shaft 106, and shock absorbers 108 transmit forces between the plate 109 and the outer linkage member 23. The support assembly 105 permits the drive shaft segment 90 to rotate through a limited range of motion about the universal joint 100C that is connected to the input shaft 34. This arrangement ensures that universal joint 100B interconnecting the drive shaft segments 88 and 90 stays within its operational range as boom member 22 is rotated upwardly or downwardly. By permitting some rotation about universal joint 100C at input shaft 34, the angle of rotation of the other two universal joints 100A and 100B is reduced.

Figure 6:
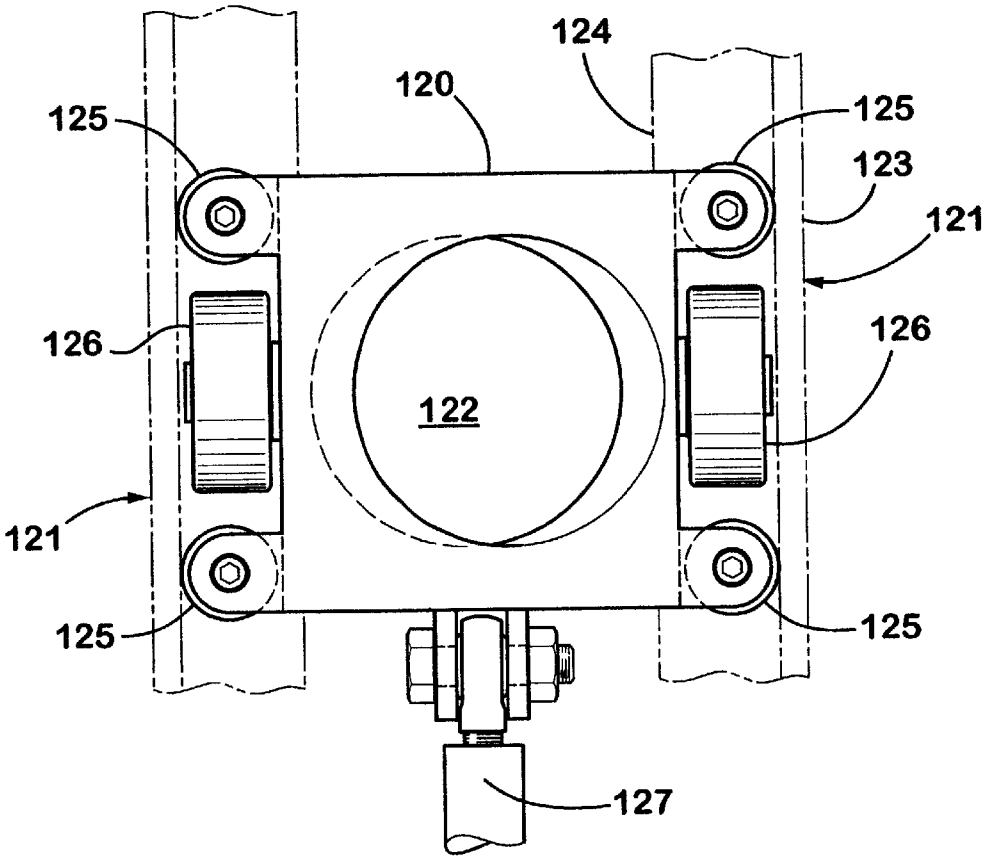
FIG. 6 is a partially fragmentary view of the pillow block and arcuate track.
Figure 5:
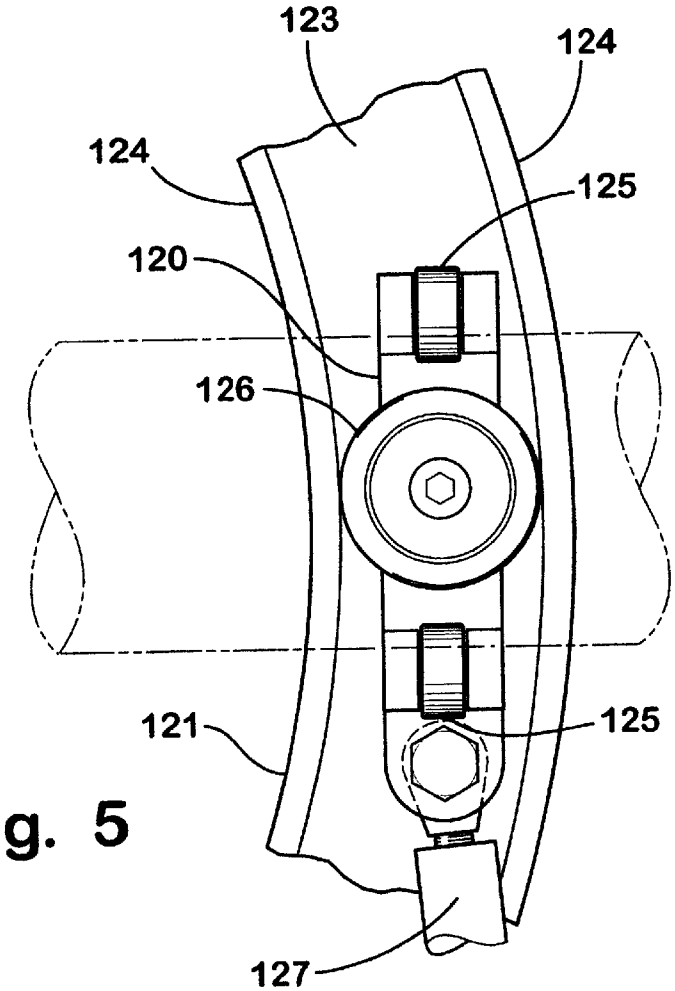
FIG. 5 is a partially fragmentary view of the pillow block and arcuate track.

A pillow block 120 rotatably supports drive shaft segment 88, and shifts the second end 96 of drive shaft segment 88 upwardly as boom member 22 is rotated upwardly, and also shifts drive shaft segment 88 downwardly as boom member 22 is rotated downwardly. With further reference to FIGS. 5 and 6, pillow block 120 has a large opening 122 through the central portion that rotatably receives the drive shaft segment 88. A pair of arcuate tracks 128 have a U-shaped cross section formed by a base web 123, and a pair of sidewalls 124 that extend from base web 123. The arcuate tracks 121 are parallel and horizontally spaced-apart, with the U-shaped cross sections opening towards one another. Pillow block 120 includes four small rollers 125 mounted at the four corners of the pillow block 120. The small rollers 125 engage the base web 123 of the arcuate tracks 121. Pillow block 120 further includes a pair of larger rollers 126 that have an overall diameter that is slightly less than the inner distance between the sidewalls 124. Pillow block 120 is pivotally connected to a small link 127. The small link 127 is, in turn, pivotally connected to end 129 of a pivot arm 128. Pivot arm 128 is fixed to the inner linkage member 21, and rotates therewith. Arcuate tracks 121 define a radius about a center point coincident with universal joint 100A interconnecting drive shaft segment 88 to output shaft 47 of motor 46. The length of the pivot arm 128 is substantially less than this radius, and the pivot arm 128 rotates about pivot 24 with the inner linkage member 21. As pivot arm 128 rotates, force is transmitted through the small link 127 into pillow block 120, thus rotating the end 96 of drive shaft segment 88 about the universal joint 100B connected to the end 92 of drive shaft segment 88. Because the pivot arm 128 is relatively short and pivots about the pin 56, the end 96 of drive shaft segment 88 rotates upwardly at a smaller angular rotation rate than boom member 22. Accordingly, when the boom member 22 is rotated to the fully upward position (FIG. 8) both universal joints 100A and 100B at ends 92 and 96 of drive shaft segment 88 are at an angle, thus reducing the angle of the universal joints that would be required if only a single universal joint 100A were utilized at output shaft 47. Pivoting all three universal joints 100A, 100B, and 100C permits upward rotation of boom member 22 to about a 45° angle (FIG. 8). Also, as illustrated in FIG. 9, the pillow block 120 and support assembly 105 support the drive shaft assembly 30 in a linear configuration when boom member 26 is positioned approximately vertical for digging of a trench, thus ensuring proper operation of the universal joints during digging operations.

With reference to FIG. 4, drive shaft segment 90 includes an inner member 130 that telescopically connects to an outer member 131 by a spline connector 132 that is covered by a bellows-type extendable rubber cover 130. The variable length of drive shaft segment 90 permits the overall length of the drive shaft 30 to change as required due to rotation of boom members 22 and/or 26.

Figure 7:
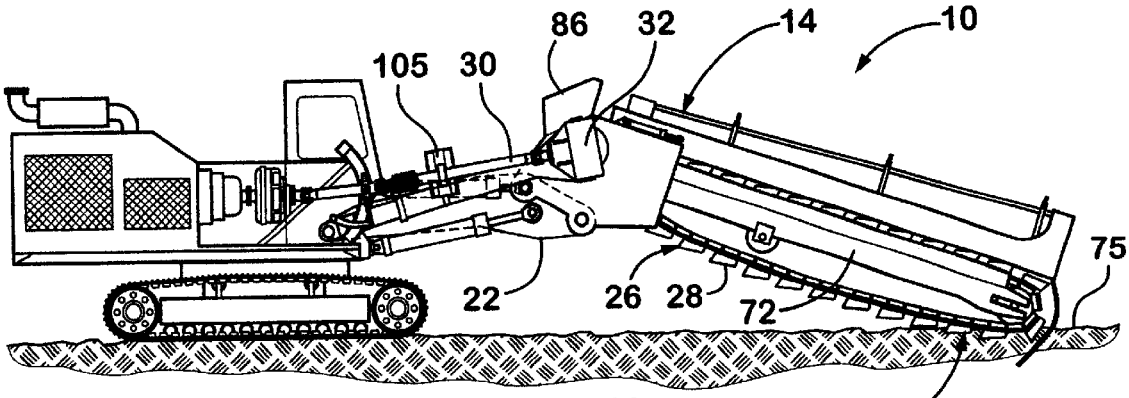
FIG. 7 is a side elevational view of the trencher of FIG. 1 illustrating the digging chain in a shallow position.
Figure 9:
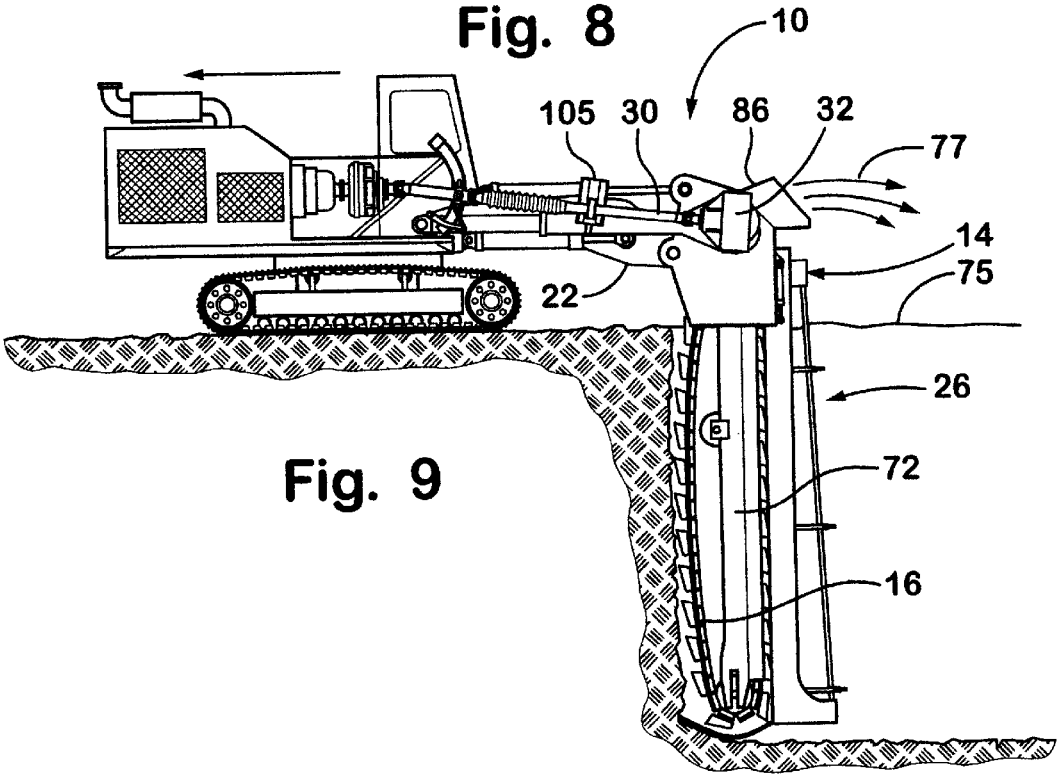
FIG. 9 is a side elevational view of the trencher of FIG. 1 wherein the digging chain is fully extended downwardly to dig a trench.

With reference to FIGS. 7–9, during operation of the shaft driven trencher 10 the base 12 is moved to the front of a line where a trench will be dug. At the starting point, the first boom member 22 is angled upward from the floor plate 38 of the base 12 and the second boom member 26 is angled slightly downward from the first boom member 22 such that the end of the arm 72 and the chain digging assembly 16 do not extend below the earth's surface 75. The operator of the trencher 10 then maneuvers the boom assembly 14 to rotate downward, thereby engaging the front of the chain digging assembly 16 with the ground. As the buckets 28 of the chain assembly 16 come into contact with the ground (FIG. 7), the openings 82 on the buckets 28 move towards the base 12 and scoop up dirt 77. The buckets 28 will continue to transport the dirt 77 towards the housing 70 of the second boom assembly 26. When the buckets 28 reach the housing 70 of the second boom assembly 26, the buckets 28 will move upward through a channel 84 in the housing 70 and along the oval track of the chain 74. The dirt in the buckets 28, however, will continue to move upward through the opening 82 in the buckets 28 as the buckets 28 start to move along the top of the arm 72. The dirt therefore shoots out of the top of the housing 70 through a chute 86, expelling the dirt from the second boom member 26. After rotating the first boom member 22 and the second boom member 26 downward to the position illustrated in FIG. 9, the base 12 is slowly moved in the direction of the arrow "A", thereby constantly engaging the buckets 28 of the chain digging assembly 16 with dirt in the trench.

The drive shaft and linkage arrangement of the present invention permits use of a long arm 72 and corresponding chain digging assembly 16. Accordingly, the trencher of the present invention can be utilized to dig very deep trenches, including trenches 20 feet or more in depth. Furthermore, because the digging chain 16 is driven through a drive shaft rather than a chain drive, engine 46 may have substantial power, thus facilitating digging of deep trenches at a high rate.

The above description is considered that of the preferred embodiment only. Modification of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A shaft driven trencher comprising:

a mobile powered base;

a boom assembly including a first boom member pivotally mounted to the base at a first pivot and a second boom member pivotally mounted to the first boom member;

a chain digging assembly including a plurality of buckets, the chain digging assembly movably mounted on the second boom member and forming a loop configured to dig during operation;

a drive assembly operably interconnecting the mobile base and the chain digging assembly, the drive assembly including a drive shaft connected to the mobile base for powered rotation of the drive shaft, the drive assembly further including a right angle gear unit with input and output shafts forming a right angle therebetween and transferring torque from the input shaft to the output shaft, the right angle gear unit pivotally mounted to the boom assembly for rotation about the output shaft; and a linkage interconnecting the right angle gear unit with the base and pivoting the right angle gear unit during rotation of the first boom member and maintaining the input shaft of the right angle gear unit extending generally toward the first pivot.

2. The shaft driven trencher as set forth in claim 1, wherein:

the boom assembly is configured to rotate between a first position wherein the first boom member is substantially parallel with the second boom member and a second position wherein the first boom member is substantially perpendicular to the second boom member.

3. The shaft driven trencher as set forth in claim 2, wherein:

the drive shaft includes a first drive segment and a second drive segment, the first drive segment being connected to the second drive segment by a universal joint;

wherein the first drive segment is configured to pivot about the universal joint at an angle relative to the second drive segment during rotation of the first boom.

4. The shaft drive trencher as set forth in claim 3, further including:

a shaft support assembly interconnected between the base, the linkage and the drive shaft;

wherein the shaft support assembly includes a pillow block and an arm;

the pillow block being interconnected to the base and supporting the first drive segment; and the arm being interconnected to the pillow block and the linkage.

5. The shaft driven trencher as set forth in claim 4, wherein:

the shaft support assembly further includes a pair of arcuate tracks connected to the base, wherein the pillow block is configured to slide along the arcuate tracks.

6. The shaft driven trencher as set forth in claim 5, wherein:

the pillow block includes a plurality of rollers that engage the arcuate tracks.

7. The shaft driven trencher as set forth in claim 6, wherein:

at least one of the first drive segment and the second drive segment includes a first telescoping rod and a second telescoping rod, wherein the first telescoping rod telescopes within the second telescoping rod thereby allowing the second drive segment to extend; and wherein the first telescoping rod includes a spline whereby the first telescoping rod rotates with the second telescoping rod.

8. The shaft driven trencher as set forth in claim 6, wherein:

the linkage includes a platform that rotates and supports the second drive segment.

9. The shaft driven trencher as set forth in claim 5, wherein:

a hydraulic cylinder rotates the first boom about the first pivot.

10. The shaft driven trencher as set forth in claim 9, wherein:

the arm includes a first arm portion fixed to the linkage and a second arm portion pivotally attached to the first arm portion and the pillow block;

the linkage is interconnected to the first boom; and the linkage drives the arm and the pillow block within the arcuate tracks as the first boom rotates about the first pivot.

11. The shaft driven trencher as set forth in claim 10, wherein:

the arm is configured to rotate the first drive segment at substantially the same rate that the linkage rotates the second drive segment.

12. A shaft driven trencher comprising:

a mobile powered base having a power source;

a boom assembly including a first boom member pivotally mounted to the base at a first pivot and a second boom member pivotally mounted to the first boom member;

a chain digging assembly including a plurality of buckets, the chain digging assembly movably mounted to the second boom member and forming a loop configured to dig during operation;

a drive shaft including a first drive segment operably connected to the power source for powered rotation of the drive shaft, the drive shaft including a second drive segment, the first drive segment being connected to the second drive segment by a universal joint, the second drive segment supported by the boom assembly and rotating therewith as the first boom member is pivoted about the first pivot;

a pivot assembly operably connected to the boom assembly and the first drive segment, the pivot assembly including a pillow block operably connected to the boom assembly and the first drive segment, with the pillow block supporting the first drive segment and rotating the first drive segment as the first boom member is pivoted about the first pivot, the pivot assembly configured to rotate the first drive segment substantially less than the second drive segment, thereby permitting greater elevation of the boom and reducing the angle of the first and second universal joints.

13. The shaft driven trencher as set forth in claim 12, wherein:

the second drive segment is supported by a linkage operably connected to the boom assembly;

the pivot assembly is interconnected between the linkage and the drive shaft;

the pivot assembly includes an arm supporting the pillow block; and the arm is interconnected to the pillow block and the linkage.

14. The shaft driven trencher as set forth in claim 13, wherein:

the pivot assembly further includes a pair of arcuate tracks adapted to be attached to the trencher, wherein the pillow block is configured to slide along the arcuate tracks.

15. The shaft driven trencher as set forth in claim 14, wherein:

the pillow block includes a plurality of rollers that engage the arcuate tracks.

16. The shaft driven trencher as set forth in claim 15, wherein:

at least one of the first drive segment and the second drive segment includes a first telescoping rod and a second telescoping rod, wherein the first telescoping rod telescopes within the second telescoping rod thereby allowing the second drive segment to extend; and wherein the first telescoping rod includes a spline whereby the first telescoping rod rotates with the second telescoping rod.

17. The shaft driven trencher as set forth in claim 13, wherein:

the arm includes a first arm portion fixed to the linkage and a second arm portion pivotally attached to the first arm portion and the pillow block; and the linkage drives the arm and the pillow block within the arcuate tracks.

18. A shaft driven trencher comprising:

a mobile powered base having a rotation power source;

a boom assembly including a first boom member having a first end pivotally mounted to the base at a first pivot and a second boom member pivotally mounted to the first boom member at a second end of the first boom member to define a second pivot;

a chain digging assembly including a plurality of buckets, the chain digging assembly movably mounted to the second boom member and forming a loop configured to dig during operation;

a drive shaft including a first drive segment having a first end pivotally connected to the power source by a first universal joint, a second end of the first drive shaft connected to a second drive segment by a second universal joint, a right angle gear unit with input and output shafts forming a right angle therebetween and transferring torque from the input shaft to the output shaft, the right angle gear unit pivotally mounted to the boom assembly of the shaft driven trencher for rotation about the output shaft, the right angle gear unit being connected to the second drive segment whereby the second drive segment rotates the input and output shafts;

a pivot and linkage assembly supporting and rotating the drive shaft and the right angle gear unit, the pivot and linkage assembly including a linkage operably coupled to the first drive segment, the second drive segment and the right angle gear unit;

wherein the pivot and linkage assembly includes a pillow block, an arm and a pair of horizontally spaced-apart arcuate tracks, the arcuate tracks defining a radius about the first universal joint;

the pillow block being interconnected to the base and supporting the first drive segment, the pillow block positioned between the arcuate tracks and configured to slide along the arcuate tracks;

the arm being interconnected to the pillow block and the linkage, the arm rotating with the linkage and moving the pillow block along the arcuate tracks, the arm having a length substantially less than the radius defined by the arcuate tracks such that the first drive segment rotates less than the first boom member to reduce rotation about the first universal joint; and the linkage interconnecting the right angle gear unit with the base and pivoting the right angle gear unit during rotation of the first boom member and maintaining the input shaft of the right angle gear unit facing the first pivot.

19. The shaft driven trencher as set forth in claim 18, wherein:

the pillow block includes a plurality of rollers that engage the arcuate tracks.

20. The shaft driven trencher as set forth in claim 19, wherein:

at least one of the first drive segment and the second drive segment includes a first telescoping rod and a second telescoping rod, wherein the first telescoping rod telescopes within the second telescoping rod thereby allowing the second drive segment to extend; and wherein the first telescoping rod includes a spline whereby the first telescoping rod rotates with the second telescoping rod.

21. The shaft driven trencher as set forth in claim 20, wherein:

the linkage includes a platform that rotates and supports the second drive segment.

22. The shaft driven trencher as set forth in claim 21, wherein:

the arm includes a first arm portion fixed to the linkage and a second arm portion pivotally attached to the first arm portion and the pillow block; and the linkage drives the arm and the pillow block within the arcuate tracks.

* * * * *